US009199486B2

(12) United States Patent
Kakigahara

(10) Patent No.: US 9,199,486 B2
(45) **Date of Patent: *Dec. 1, 2015**

(54) RECORDING APPARATUS

(71) Applicant: Brother Kogyo Kabushiki Kaisha, Nagoya-shi, Aichi-ken (JP)

(72) Inventor: Yutaka Kakigahara, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/473,704

(22) Filed: Aug. 29, 2014

(65) Prior Publication Data

US 2015/0054899 A1 Feb. 26, 2015

Related U.S. Application Data

(63) Continuation of application No. 13/429,398, filed on Mar. 25, 2012, now Pat. No. 8,820,917.

(30) Foreign Application Priority Data

Mar. 31, 2011 (JP) ..... 2011-079593

(51) Int. Cl.
*B41J 11/00* (2006.01)
*B41J 29/02* (2006.01)
(Continued)

(52) U.S. Cl.
CPC ..... *B41J 11/0045* (2013.01); *B41J 29/02* (2013.01); *B41J 29/13* (2013.01); *B41J 29/38* (2013.01)

(58) Field of Classification Search
CPC ..... B41J 11/0045
USPC ..... 347/104, 108
See application file for complete search history.

(56) References Cited

U.S. PATENT DOCUMENTS 1,807,911 A 6/1931 Garbell
4,905,028 A 2/1990 Okubo et al.
(Continued)

FOREIGN PATENT DOCUMENTS

CN 101092084 A 12/2007
CN 101161459 A 4/2008
(Continued)

OTHER PUBLICATIONS

Japan Patent Office, Decision to Grant a Patent for Japanese Patent Application No. 2011-079593 (counterpart to co-pending U.S. Appl. No. 13/429,398), dispatched Dec. 18, 2012.
(Continued)

*Primary Examiner* — Manish S Shah
*Assistant Examiner* — Roger W Pisha, II
(74) *Attorney, Agent, or Firm* — Baker Botts L.L.P.

(57) ABSTRACT

A recording apparatus, including: a support portion; a recording portion; a first casing; a second casing; a positioning mechanism including a guide pin and a guide hole, for defining a relative position of the recording portion and the support portion by engagement of the guide pin and the guide hole when the second casing is positioned at a close position; and a movable member disposed at one end of the guide hole for moving in a direction away from the other end of the guide hole, so as to be retracted from a moving region of the guide pin that moves relative to the guide hole in association a pivotal movement of the second casing, wherein the movable member is for biasing the guide pin engaging the guide hole in a direction toward the other end of the guide hole such that the guide pin contacts the other end.

14 Claims, 10 Drawing Sheets

(51) Int. Cl.
*B41J 29/13* (2006.01)
*B41J 29/38* (2006.01)

(56) References Cited

U.S. PATENT DOCUMENTS

| | | | | |
|---|---|---|---|---|
| 5,157,416 | A | 10/1992 | Kinoshita et al. | |
| 6,443,645 | B1 | 9/2002 | Takei et al. | |
| 7,607,769 | B2 | 10/2009 | Umeda et al. | |
| 8,820,917 | B2 * | 9/2014 | Kakigahara | 347/108 |
| 2003/0118390 | A1 | 6/2003 | Yamada et al. | |
| 2004/0096256 | A1 | 5/2004 | Hayashi et al. | |
| 2005/0001893 | A1 | 1/2005 | Yu | |
| 2006/0146110 | A1 | 7/2006 | Tsuji | |
| 2006/0152546 | A1 | 7/2006 | Udagawa | |
| 2006/0283695 | A1 | 12/2006 | Deshimaru | |
| 2007/0007473 | A1 | 1/2007 | Kumagai | |
| 2007/0132819 | A1 | 6/2007 | Umeda et al. | |
| 2007/0138193 | A1 | 6/2007 | Aono et al. | |
| 2007/0252885 | A1 | 11/2007 | Zhao | |
| 2007/0296774 | A1 | 12/2007 | Lee et al. | |
| 2008/0088674 | A1 | 4/2008 | Hayakawa | |
| 2008/0170276 | A1 | 7/2008 | Mamiya | |
| 2009/0085957 | A1 | 4/2009 | Fujimori | |
| 2009/0237427 | A1 | 9/2009 | Kumagai | |
| 2009/0237477 | A1 | 9/2009 | Kumagai | |
| 2009/0244249 | A1 | 10/2009 | Chinzei et al. | |
| 2009/0274488 | A1 | 11/2009 | Sugiyama | |

FOREIGN PATENT DOCUMENTS

| | | | |
|---|---|---|---|
| CN | 101396906 | A | 4/2009 |
| EP | 1911597 | A1 | 4/2008 |
| EP | 2163390 | A1 | 3/2010 |
| JP | S63-267581 | A | 11/1988 |
| JP | H05-074100 | A | 3/1993 |
| JP | H05-039511 | U | 5/1993 |
| JP | H07-073633 | A | 3/1995 |
| JP | 2006-171649 | A | 6/2006 |
| JP | 2006-231719 | A | 9/2006 |
| JP | 2007-015138 | A | 1/2007 |
| JP | 2008-175931 | A | 7/2008 |
| JP | 2009-035929 | A | 2/2009 |
| JP | 2009-205056 | A | 9/2009 |
| JP | 2011-073229 | A | 4/2011 |

OTHER PUBLICATIONS

European Patent Office, European Search Report for European Patent Application No. 12160374.0 (counterpart to co-pending U.S. Appl. No. 13/429,398), dated Jan. 30, 2013.

The State Intellectual Property Office of the People's Republic of China, Notification of First Office Action for Chinese Patent Application No. 201210075536.0 (counterpart to co-pending U.S. Appl. No. 13/429,398), issued Jan. 21, 2014.

* cited by examiner

RECORDING APPARATUS

CROSS REFERENCE TO RELATED APPLICATION

The present application is a continuation of U.S. patent application Ser. No. 13/429,398, which was filed on Mar. 25, 2012, which claims priority from Japanese Patent Application No. 2011-079593, which was filed on Mar. 31, 2011, the disclosures of which are herein incorporated by reference in their entirety.

BACKGROUND OF THE INVENTION

1. Field of the Invention

The present invention relates to a recording apparatus configured to record an image on a recording medium.

2. Description of Related Art

There is a known recording apparatus including a positioning mechanism including a guide pin (e.g. positioning pin) that extends along a prescribed direction and a guide hole (e.g. guide portion) with which the guide pin is to be engaged. In the recording apparatus, a relative position of a recording portion (e.g. recording unit) and a support portion (e.g. conveyer device) for supporting a recording medium is fixed by engagement of the guide pin and the guide hole.

SUMMARY OF THE INVENTION

If the above-described recording apparatus is configured such that the recording portion pivots relative to the support portion about a prescribed shaft for ensuring, between the recording portion and the support portion, a space in which a user performs a maintenance operation, the following problems may arise. That is, where the recording portion is pivoted relative to the support portion in a state in which the guide pin and the guide hole are held in engagement with each other, the guide pin interferes with the wall which defines the guide hole.

It is therefore an object of the invention to provide a recording apparatus which ensures positioning accuracy by engagement of a guide hole and a guide pin while restraining interference between the guide pin and a wall that defines the guide hole.

To attain the object indicated above, the present invention provides a recording apparatus, comprising:

a support portion configured to support a recording medium;

a recording portion configured to record an image on the recording medium supported by the support portion;

a first casing configured to hold the support portion;

a second casing connected to the first casing through a shaft and pivotable relative to the first casing about the shaft, the second casing being configured to be selectively positioned by a pivotal movement thereof at one of: a close position at which the second casing is positioned close to the first casing; and a separate position at which the second casing is positioned more distant from the first casing than when the second casing is positioned at the close position, the second casing being configured to hold the recording portion such that the support portion and the recording portion are opposed to each other when the second casing is positioned at the close position;

a positioning mechanism including a guide pin that extends in a prescribed direction and a guide hole which move relative to each other in association with the pivotal movement of the second casing, the positioning mechanism being configured to define a relative position of the recording portion and the support portion by engagement of the guide pin and the guide hole when the second casing is positioned at the close position; and a movable member disposed at one end of the guide hole in an orthogonal direction orthogonal to both of the prescribed direction and an extension direction in which the shaft extends, the movable member being configured to move in a direction away from the other end of the guide hole in the orthogonal direction, whereby the movable member is retracted from a moving region of the guide pin that moves relative to the guide hole in association with the pivotal movement of the second casing, wherein the movable member is configured to bias the guide pin that is in engagement with the guide hole in a direction toward the other end of the guide hole such that the guide pin contacts the other end of the guide hole.

BRIEF DESCRIPTION OF THE DRAWINGS

The above and other objects, features, advantages and technical and industrial significance of the present invention will be better understood by reading the following detailed description of an embodiment of the invention, when considered in connection with the accompanying drawings, in which.

DETAILED DESCRIPTION OF THE EMBODIMENT

There will be explained one embodiment of the present invention with reference to the drawings.

Figure 1:
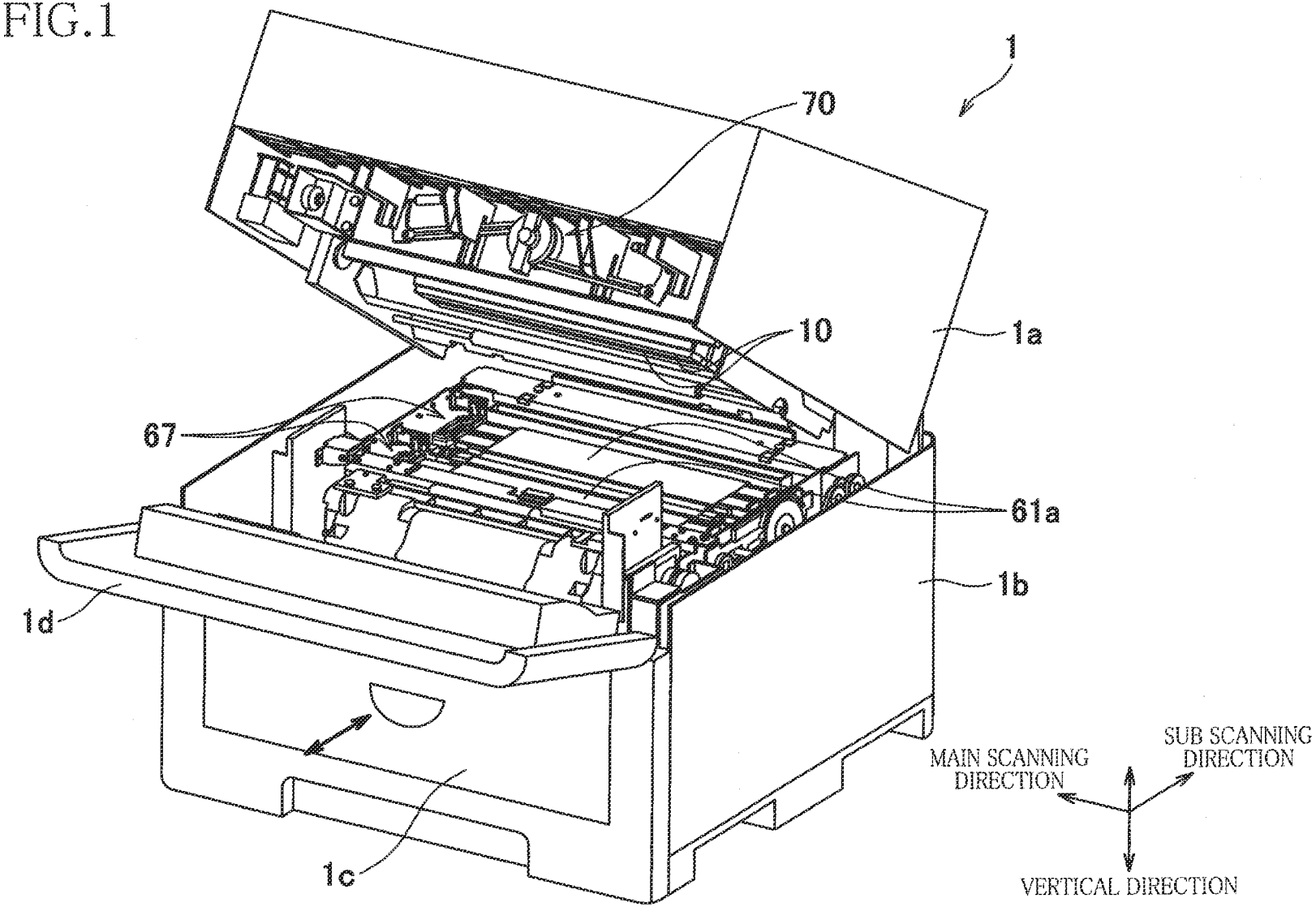
FIG. 1 is a perspective view showing an appearance of an ink-jet printer according to one embodiment of the invention.
Figure 2:
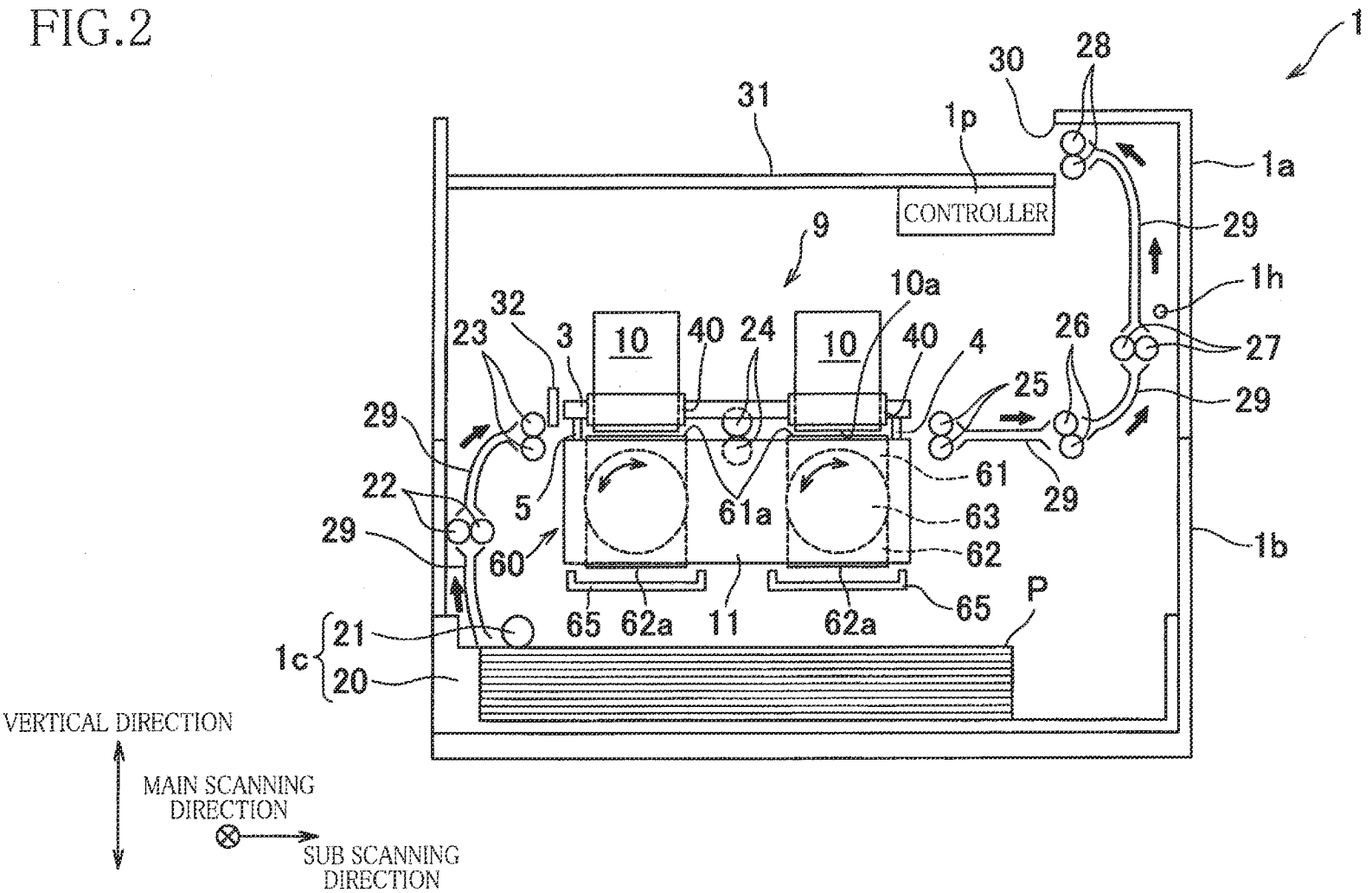
FIG. 2 is a schematic side view showing an inside of the printer.

Referring first to FIGS. 1 and 2, there will be explained an overall structure of an inkjet printer 1 as one embodiment of a recording apparatus of the invention.

The printer 1 includes an upper casing 1*a* as a second casing and a lower casing 1*b* as a first casing both of which have a rectangular parallelepiped shape and are substantially identical in size. The lower surface of the upper casing 1*a* is open while the upper surface of the lower casing 1*b* is open. The upper casing 1*a* is superimposed on the lower casing 1*b* so that the opening surfaces of the respective upper and lower casings 1*a*, 1*b* are closed, whereby a space is defined in the printer 1, as shown in FIG. 2. On a top plate of the upper casing 1*a*, a discharge portion 31 is provided. In the space defined by the upper and lower casings 1*a*, 1*b*, a sheet conveyance path is formed through which a sheet P as a recording medium is conveyed from a sheet supply unit 1*c* (which will be explained) to the discharge portion 31 along bold arrows shown in FIG. 2.

Figure 5:
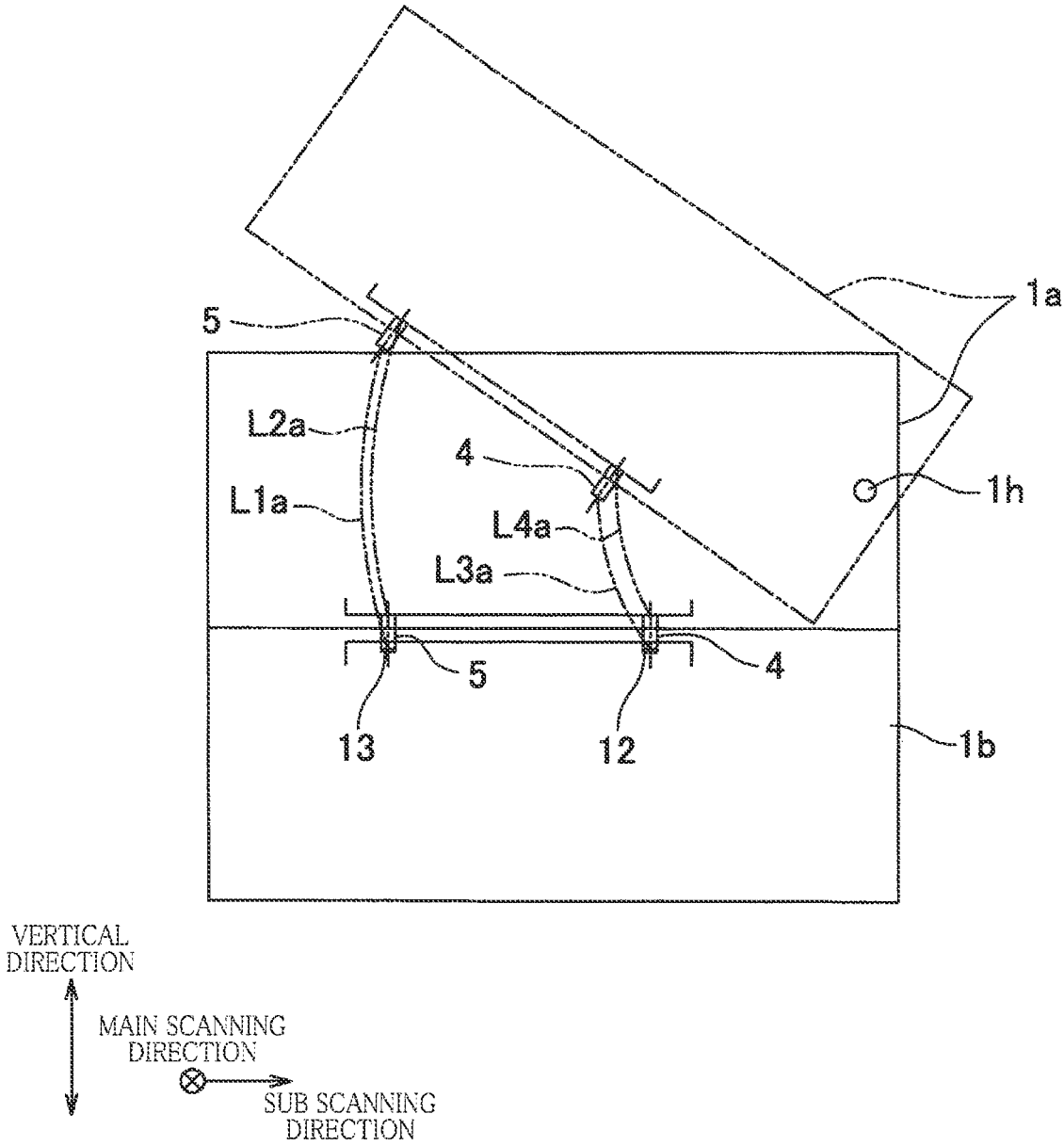
FIG. 5 is an explanatory view showing moving regions of the respective guide pins when an upper casing shown in FIG. 2 is pivoted.

As shown in FIG. 2, the upper casing 1*a* is connected to the lower casing 1*b* via a shaft 1*h* that extends in a main scanning direction at a substantially vertically middle position of one end portion (right end portion in FIG. 2) of the upper casing 1*a* in a sub scanning direction. The upper casing 1*a* is pivotable about the shaft 1*b* relative to the lower casing 1*b* as shown in FIG. 5. The upper casing 1*a* pivots such that the upper casing 1*a* is selectively positioned at one of a close position (FIG. 2) at which the upper casing 1*a* is positioned close to the lower casing 1*b*, namely, the upper casing 1*a* and the lower casing 1*b* are in a closed state; and a separate position (FIG. 1) at which the upper casing 1*a* is positioned more distant from the lower casing 1*b* than when the upper casing 1*a* is positioned at the close position, namely, the upper casing 1*a* and the lower casing 1*b* are in an opened state. When the upper casing 1*a* is positioned at the separate position, a part of the sheet conveyance path defined by the upper casing 1*a* and the lower casing 1*b* when the upper casing 1*a* is positioned at the close position is exposed to an exterior, thereby ensuring a work space for a user above the sheet conveyance path. When the work space is ensured by positioning the upper casing 1*a* at the separate position, the user can remove the sheet P jammed in the sheet conveyance path or can perform a maintenance operation on a recording portion 9 or a support portion 60. The maintenance operation on the recording portion 9 or the support portion 60 includes an operation for removing stains adhering to an ejection surface 10*a* (as a recording surface), a support surface 61*a*, or an opposable face 62*a* (explained later), for instance. The shaft 1*b* is provided with a spring (not shown) which biases the upper casing 1*a* in a direction in which the upper casing 1*a* is opened, namely, in a direction from the close position to the separate position. In the present embodiment, the upper casing 1*a* is openable with respect to the horizontal plane at an inclination angle up to substantially 35°.

On the front side of the upper casing 1*a*, namely; on the front left side of the sheet plane of FIG. 1, there is provided a locking mechanism 70 configured to prohibit the pivotal movement of the upper casing 1*a* when the upper casing 1*a* is positioned at the close position. On the front side of the lower casing 1*b*, there is provided an openable lid 1*d* covering the front surface of the upper casing 1*a*. By opening the lid 1*d*, the locking mechanism 70 is exposed, whereby the locking mechanism 70 is operable. To pivot the upper casing 1*a* from the close position to the separate position, the lid 1*d* is initially opened, and the locking mechanism 70 is subsequently unlocked, so as to pivot the upper casing 1*a*. On the other hand; to return the upper casing 1*a* from the separate position to the close position, the upper casing 1*a* is first pivoted from the separate position to the close position, the locking mechanism 70 is subsequently locked, and then the lid 1*d* is closed.

The upper casing 1*a* accommodates: two heads 10, i.e., a pre-coat head 10 for ejecting a pre-treatment liquid and an ink-jet head 10 for ejecting black ink, which are arranged in this order from the upstream side in a sheet conveyance direction (indicated by the bold arrows in FIG. 2) in which the sheet P is conveyed; a frame 3 supporting the two heads 10 and an upper roller of a feed roller pair 24; a head elevating and lowering mechanism 33 (FIG. 7) as a moving mechanism configured to elevate and lower the frame 3 in the vertical direction; two cartridges (not shown) respectively corresponding to the two heads 10; and a controller 1*p* (FIG. 2) configured to control operations of various portions of the printer 1. In the present embodiment, the two heads 10 and the frame 3 constitute a recording portion 9 configured to record an image on the sheet P. The recording portion 9 is held by the upper casing 1*a* via the head elevating and lowering mechanism 33.

The upper casing 1*a* further accommodates upper rollers of respective feed roller pairs 25, 26, an upper guide portion of a guide 29 disposed between the feed roller pairs 25, 26, feed roller pairs 27, 28, and two guides 29 disposed between the feed roller pairs 26, 28 along the sheet conveyance direction. In other words, when the upper casing 1*a* pivots from the close position to the separate position, these components accommodated in the upper casing 1*a* are moved together with the upper casing 1*a*. In FIG. 2, illustration of a part of components accommodated in the upper casing 1*a* is omitted.

The lower casing 1*b* accommodates or holds the support portion 60, wiper units 67, two waste-liquid discharge trays 65, and the sheet supply unit 1*c*. The lower casing 1*b* further accommodates a sheet sensor 32, feed roller pairs 22, 23, and two guides 29 disposed between the sheet supply unit 1*c* and the feed roller pair 23 along the sheet conveyance direction.

Figure 7:
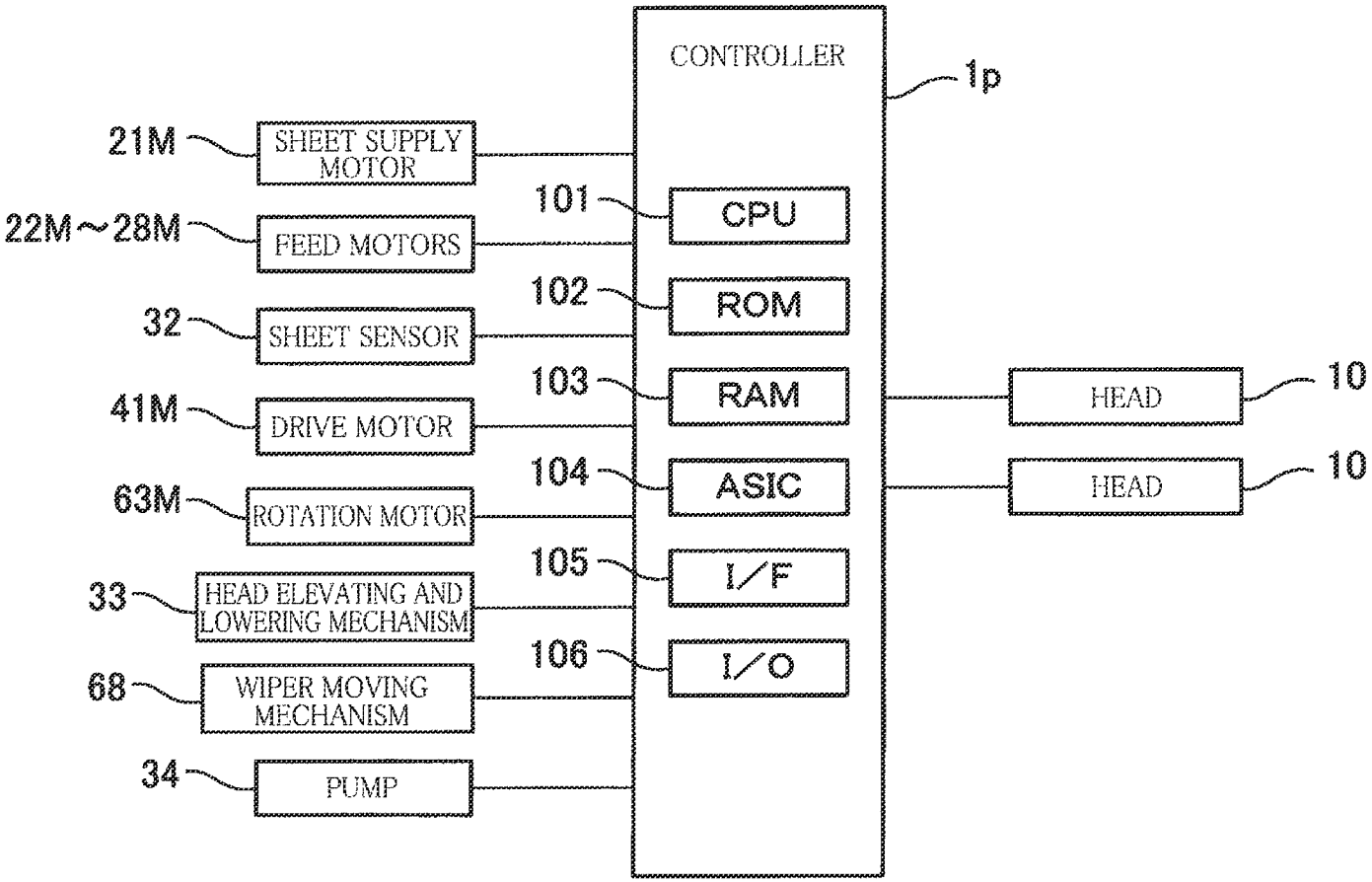
FIG. 7 is a block diagram showing an electric structure of the printer.

The cartridges respectively store the pre-treatment liquid and the black ink (hereinafter collectively referred to as the "liquid" where appropriate) to be supplied to the respective heads 10. The pre-treatment liquid has a function of preventing ink spreading and ink strikethrough, a function of improving a color development property of ink and a quick-drying property of ink, etc. The cartridges are connected to the corresponding heads 10 via respective tubes (not shown) and respective pumps 34 (FIG. 7). Each pump 34 is configured to be driven by the controller 1*p* only when the liquid is forcibly supplied to the corresponding head 10 such as when a purging operation is carried out or when the liquid is initially introduced. Since a negative pressure is generated in liquid passages in each head 10 when an image recording operation is carried out, the liquid in the cartridge is automatically supplied to the corresponding head 10.

Each head 10 is line-type head that has a long dimension in the main scanning direction and has a substantially rectangular parallepiped contour. The two heads 10 are supported by the frame 3 so as to be spaced apart from each other in the sub scanning direction. In each head 10, a joint to which the tube is attached is provided on its upper surface, and a multiplicity of ejection openings are open in its lower surface functioning as the ejection surface 10*a*. In the inside of each head 10, there are formed liquid passages through which the liquid supplied from the cartridge flows to the ejection openings. The frame 3 is provided with enclosure members 40 each of which encloses or surrounds a lower end portion of the periphery of the corresponding head 10. The structure of the enclosure member 40 will be explained in detail.

The head elevating and lowering mechanism 33 is configured to elevate and lower the frame 3 in the vertical direction (as a prescribed direction) so as to move the two heads 10 between a recording position and a retracted position (as a second position), when the upper casing 1*a* is positioned at the close position. At the recording position, the two heads 10 are opposed to the support portion 60, more specifically, the respective support surfaces 61*a* in a first state that will be explained, with a distance suitable for recording interposed therebetween. The recording position includes: a first recording position (as a first position) at which recording is performed on the sheet P with relatively small thickness such as plain paper; and a second recording position (as a third position) at which recording is performed on the sheet P such as thick paper and at which a distance from the support surfaces 61*a* is larger than a distance from the support surfaces 61*a* at the first recording position. The controller 1*p* controls the head elevating and lowering mechanism 33 depending upon the type of the sheet P on which the image is to be recorded, such that the heads 10 are disposed at a corresponding one of the two recording positions (FIG. 9). At the retracted position, the two heads 10 are located away from the support portion 60, more specifically, the respective opposable faces 62*a* in a second state that will be explained, with a larger distance interposed therebetween than the distance between the support portion 60 and the second recording position.

The sheet supply unit 1*c* includes a sheet tray 20 and a sheet supply roller 21. The sheet tray 20 is attachable to and detachable from the lower casing 1*b* in the sub scanning direction. The sheet tray 20 is a box opening upward and is capable of accommodating a plurality of kinds of the sheet P. The sheet supply roller 21 is rotated under the control of the controller 1*p* so as to supply an uppermost one of the sheets P accommodated in the sheet tray 20. The sheet P supplied by the sheet supply roller 21 is fed to the support portion 60 while being guided by the guides 29 and held or nipped by the rollers of the respective feed roller pairs 22, 23.

The support portion 60 is disposed so as to be opposed to the recording portion 9 in the vertical direction. The support portion 60 includes: two rotary members 63 opposed to the respective heads 10; two platens 61 and two opposable members (each as an opposable portion) 62, the platen 61 and the opposable member 62 being fixed to the circumferential surface of the corresponding rotary member 63; and a frame 11 rotatably supporting the two rotary members 63. Each rotary member 63 has a shaft extending in the main scanning direction and is configured to rotate about the shaft under the control of the controller 1*p*. The frame 11 also rotatably supports a lower roller of the feed roller pair 24.

Each platen 61 and each opposable member 62 have a size in the main scanning direction and in the sub scanning direction slightly larger than the ejection surface 10*a*. The platen 61 and the opposable member 62 are disposed on one and the other of opposite sides of the rotary member 63 in the vertical direction.

The surface of the platen 61 functions as the support surface 61*a* for supporting the sheet P while facing the ejection surface 10*a*. The surface of the platen 61 is formed of a suitable material or suitably processed, for enabling the sheet P to be held thereon. For instance, a low-tack silicone layer may be formed on the support surface 61*a*, or a multiplicity of ribs may be formed on the surface of the platen 61 along the sub scanning direction, whereby the sheet P placed on the support surface 61*a* is prevented from floating. The platen 61 is formed of a resin.

The opposable member 62 is formed of a material that inhibits or hardly inhibits transmission of an aqueous component therethrough. The surface of the opposable member 62 is smooth and functions as the opposable face 62*a* to be opposed to the ejection surface 10*a* of the corresponding head 10.

By rotation of the rotary members 63, there are selectively established: the first state (FIG. 2) in which the support surfaces 61*a* are opposed to the corresponding ejection surfaces 10*a* and the opposable faces 62*a* are not opposed to the corresponding ejection surfaces 10*a*; and the second state (FIGS. 6 and 9) in which the support surfaces 61*a* are not opposed to the corresponding ejection surfaces 10*a* and the opposable faces 62*a* are opposed to the corresponding ejection surfaces 10*a*. In the present embodiment, the controller 1*p* controls driving of the rotary members 63 such that the first state is established when the image is recorded on the sheet P by ejection of the liquids from the ejection openings toward the sheet P and such that the second state is established when the purging operation or the wiping operation is carried out and when the heads 10 are in the capping state.

Each waste-liquid discharge tray 65 is disposed below the corresponding rotary member 63, etc., and is held in communication with a waste-liquid tank (not shown). The liquid dropped from the above in the purging operation or the wiping operation is received by and accumulated in the corresponding waste-liquid discharge tray 65 and is discharged to the waste-liquid tank.

Each wiper unit 67 has a wiper 67*a* (FIG. 9) and a wiper moving mechanism 68 (FIG. 7) configured to reciprocatingly move the wiper 67*a* in the main scanning direction. The wiper moving mechanism 68 is controlled by the controller 1*p* to move the wiper 67*a* in the main scanning direction from a standby position (FIG. 1) which is located on the back side of the corresponding rotary member 63, etc., in FIG. 2. Each wiper 67*a* is formed of an elastic material such as rubber and is a plate-like member extending in the sub scanning direction. Each wiper 67*a* is supported by the corresponding wiper moving mechanism 68 such that its upper end is in contact with the corresponding ejection surface 10*a* and its lower end is in contact with the corresponding opposable face 62*a*, when the wiper 67*a* moves in the main scanning direction at a wiping position (which will be explained) of the head 10, whereby the liquid adhering to the ejection surface 10*a* and the opposable face 62*a* is removed by the wiper 67*a*, namely, cleaning of the ejection surface 10*a* and the opposable face 62*a* is carried out.

Referring next to FIGS. 2 and 4, the frame 3 will be explained.

Figure 4A:
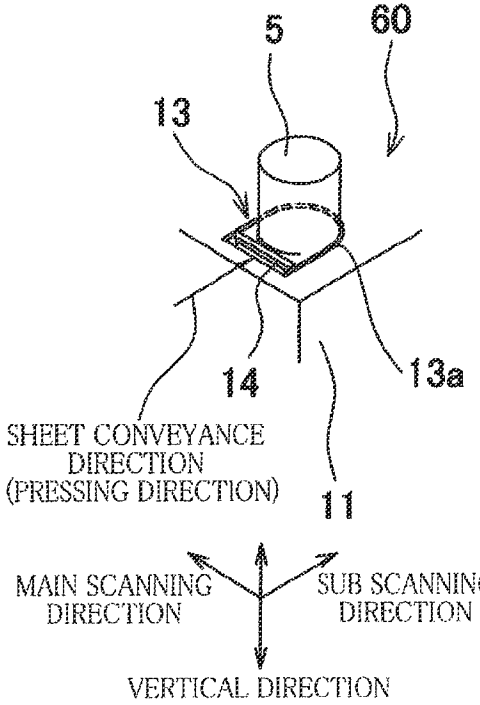
FIG. 4 A is an enlarged perspective view showing an engaged state of a guide pin and a guide hole.
FIG. 4B is a view showing a state in which the guide pin is biased by a movable member.
FIG. 4C is a view showing a state in which the movable member is retracted in association with a movement of the guide pin.
FIG. 4D is a view showing a state in which the guide pin comes out of the guide hole.
Figure 4B:
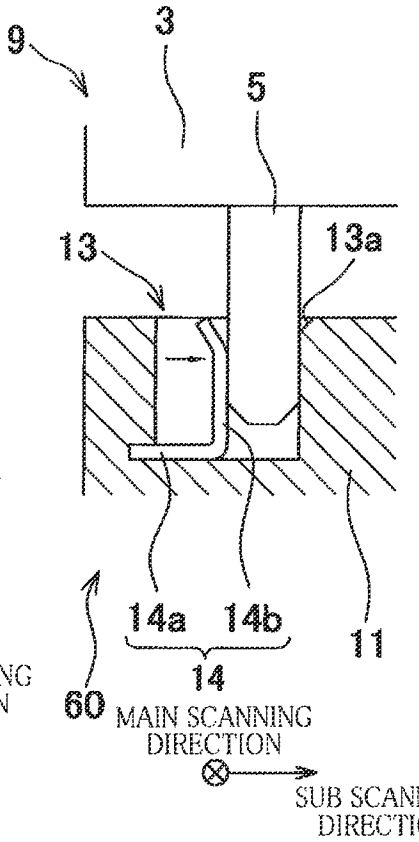
Figure 4C:
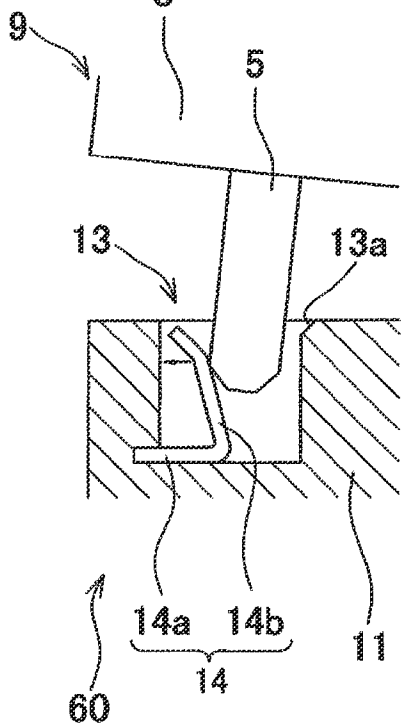

The frame 3 supports the two heads 10 and an upper roller of the feed roller pair 24. The frame 3 also supports the enclosure members 40 such that the enclosure members 40 are elevated and lowered. As shown in FIG. 2, the frame 3 includes two guide pins 4, 5. The guide pins 4, 5 are disposed on the lower surface of the frame 3 at respective positions where the guide pins 4, 5 are to be opposed to corresponding guide holes 12, 13 that will be explained. Each of the guide pins 4, 5 is formed of a tapered cylindrical member (FIG. 4). The guide pins 4, 5 extend in the vertical direction (the prescribed direction) when the upper casing 1*a* is positioned at the close position and the two heads 10 are positioned at the recording position (as indicated in FIGS. 2 and 4B).

Referring next to FIGS. 2-5, the frame 11 will be explained.

Figure 3:
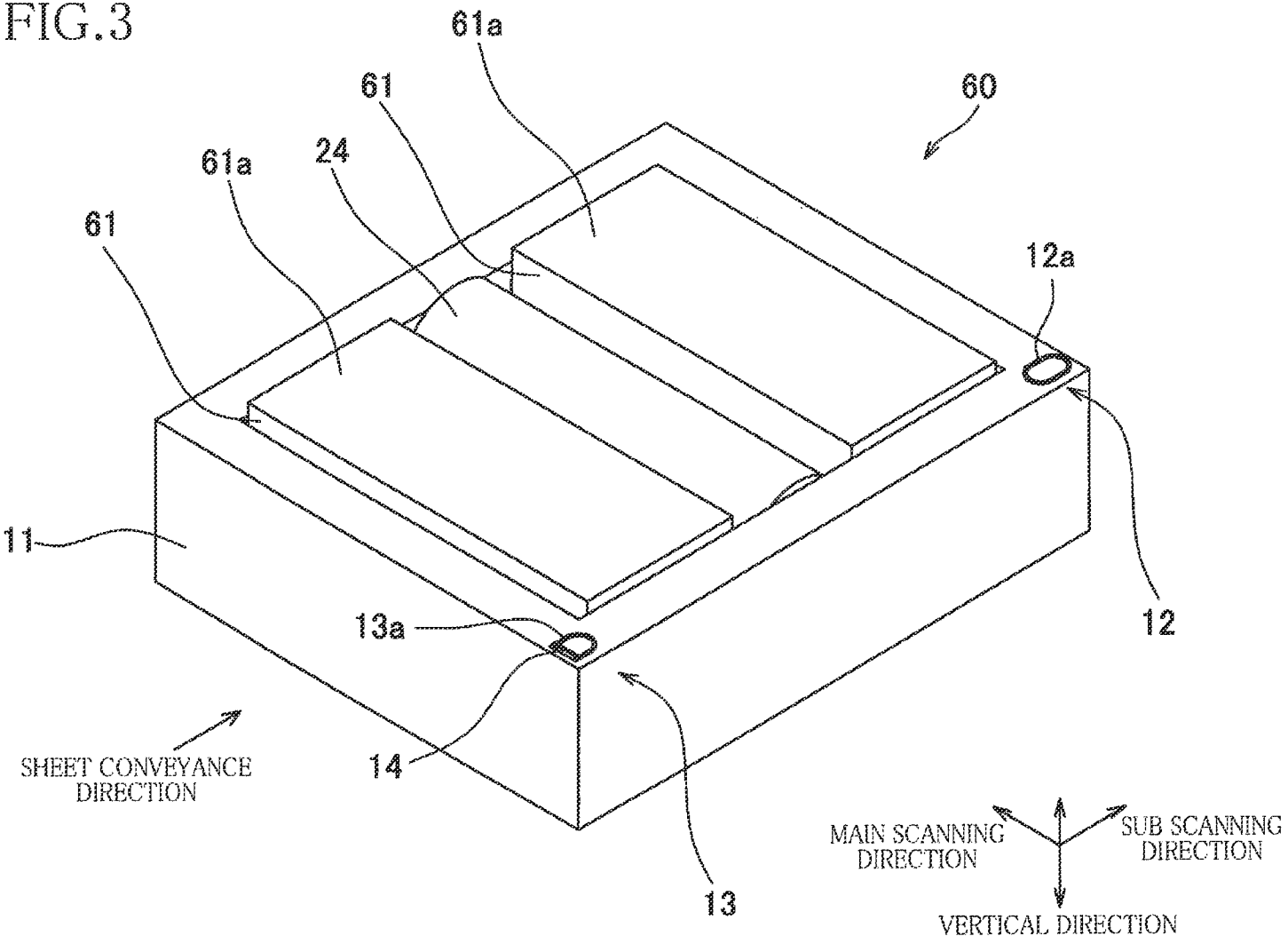
FIG. 3 is a schematic perspective view of a support portion shown in FIG. 2.

As shown in FIG. 3, the frame 11 has a short sleeve-like shape. The frame 11 rotatably supports the two rotary members 63 and a lower roller of the feed roller pair 24. On the upper surface of the frame 11, the two guide holes 12, 13 with which the respective guide pins 4, 5 are to be engaged are formed. The guide pins 4, 5 are inserted into the respective guide holes 12, 13 when the heads 10 (the recording portion 9) are located at the recording position (the first or the second recording position) and the upper casing 1*a* is located at the close position. The guide pins 4, 5 are inserted into the respective guide holes 12, 13, whereby the guide pins 4, 5 and the guide holes 12, 13 come into engagement with each other. The guide pins 4, 5 and the guide holes 12, 13 constitute a positioning mechanism configured to position the recording portion 9 and the support portion 60 relative to each other in the horizontal direction. That is, the guide pins 4, 5 have a length for enabling the guide pins 4, 5 to be engaged with or insertable into the respective guide holes 12, 13 when the upper casing 1*a* is located at the close position and the heads 10 are located at the recording position. Further, the length of the guide pin 4, 5 is determined such that the guide pins 4, 5 are inhibited from being engaged with the respective guide holes 12, 13 when the upper casing 1*a* is located at the close position and the heads 10 are located at the retracted position.

The two guide holes 12, 13 are formed at respective corners of the frame 11 located at one side of the frame 11 in the main scanning direction, i.e., at the respective corners of the frame 11 located on the right side in FIG. 3, so as to be arranged along the sub scanning direction.

As shown in FIG. 3, the guide hole 12 is an elongate hole that is long in the sub scanning direction. The guide hole 12 is configured such that two opposing inner wall surfaces thereof extending along the sub scanning direction are to come into contact with two portions of the outer circumferential surface of the guide pin 4 that are opposed to each other in the main scanning direction, when the upper casing 1*a* is located at the close position and the heads 10 are located at the recording position. According to the arrangement, the relative position of the guide pin 4 and the guide hole 12 in the main scanning direction can be fixed, namely, the guide pin 4 and the guide hole 12 can be positioned relative to each other in the main scanning direction.

As shown in FIG. 4, the guide hole 13 is an elongate hole that is long in the sub scanning direction. The guide hole 13 is configured such that its downstream-side semi-circular inner wall surface in the sheet conveyance direction is to come into contact with portions of the outer circumferential surface of the guide pin 5 that are opposed to each other in the main scanning direction and a downstream-side end portion of the outer circumferential surface of the same 5, when the upper casing 1*a* is located at the close position and the heads 10 are located at the recording position. According to the arrangement, the relative position of the guide pin 5 and the guide hole 13 in the main scanning direction and in the sub scanning direction can be fixed, namely, the guide pin 5 and the guide hole 13 can be positioned relative to each other in the main scanning direction and in the sub scanning direction.

In the present embodiment, the upper casing 1*a* is pivotably supported by the shaft 1*h* at a substantially middle position in the vertical direction of the right end portion (in FIG. 5) of the upper casing 1*a*. Accordingly; when the upper casing 1*a* is pivoted from the close position to the separate position, the guide pins 4, 5 that are in engagement with the respective guide holes 12, 13 are moved to the upper left side in FIG. 5 with respect to the guide holes 12, 13 and are disengaged therefrom. In other words, in association with the pivotal movement of the upper casing 1*a*, the guide pins 4, 5 move toward the left ends of the inner wall surfaces of the respective guide holes 12, 13 (i.e., toward the upstream ends of the respective guide holes 12, 13 in the sheet conveyance direction) while moving away from the right ends of the inner wall surfaces of the respective guide holes 12, 13 (i.e., the downstream ends of the respective guide holes 12, 13 in the sheet conveyance direction).

Here, the guide hole 12 is configured such that its upstream-side inner wall surface in the sheet conveyance direction (located on the upstream side of the center of the guide hole 12) does not come into contact with the outer circumferential surface of the guide pin 4, when the upper casing 1*a* is pivoted from the close position to the separate position with the heads 10 located at the recording position. In other words, the guide hole 12 is configured such that a moving region of the guide pin 4 (i.e., a region between arcs L3*a*, L4*a* indicated by the long dashed double-short dashed lines in FIG. 5) falls within the guide hole 12, namely, the inner wall of the guide hole 12 does not exist in the moving region of the guide pin 4. Accordingly, the guide pin 4 does not interfere with the inner wall of the guide hole 12 when the upper casing 1*a* is pivoted.

Further, the guide hole 13 is configured such that its upstream-side inner wall surface in the sheet conveyance direction (located on the upstream side of the center of the guide hole 13) does not come into contact with the outer circumferential surface of the guide pin 5, when the upper casing 1*a* is pivoted from the close position to the separate position with the heads 10 located at the recording position. In other words, the guide hole 13 is configured such that a moving region of the guide pin 5 (i.e., a region between arcs L1*a*, L2*a* indicated by the long dashed double-short dashed lines in FIG. 5) falls within the guide hole 13, namely, the inner wall of the guide hole 13 does not exist in the moving region of the guide pin 5. Accordingly the guide pin 5 does not interfere with the inner wall of the guide hole 13 when the upper casing 1*a* is pivoted.

Figure 4D:
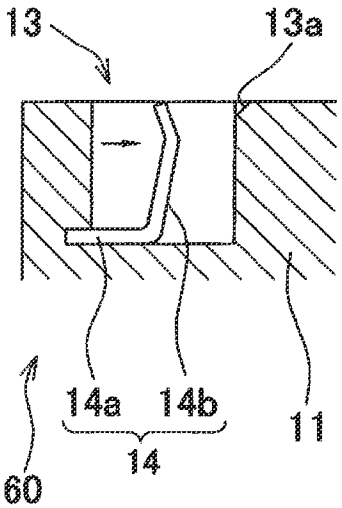

In the guide hole 13, a movable member 14 (as a biasing portion) is provided. As shown in FIG. 4B, the movable member 14 in the present embodiment is constituted by a leaf spring as an elastic body having an "L"-shaped cross sectional shape. The movable member 14 is fixed to one end of the guide hole 13 in the sub scanning direction, i.e., in a direction orthogonal to the shaft 1*h* and the extension direction of the guide pin 5. More specifically, the movable member 14 includes: a horizontal portion 14*a* (as one example of a first portion) which extends along the sub scanning direction and one end of which is fixed to the left end of the inner wall surface (the upstream end in the sheet conveyance direction) of the guide hole 13; and an upright portion 14*b* (as one example of a second portion) extending upward from the other end of the horizontal portion 14*a*. The movable member 14 is configured to be positioned at a pressing position (shown in FIG. 4B) when the upper casing 1*a* is positioned at the close position and the heads 10 are positioned at the recording position. At the pressing position, the upright portion 14*b* presses the guide pin 5 that is in engagement with the guide hole 13, in the sheet conveyance direction. That is, the movable member 14 biases the guide pin 5 that is in engagement with the guide hole 13, such that the guide pin 5 is in held in abutting contact with the right end of the inner wall surface (the downstream end in the sheet conveyance direction) of the guide hole 13. The upper end of the upright portion 14*b* is a free end. Accordingly, when the upper casing 1*a* is pivoted from the close position to the separate position with the head 10 located at the recording position, the upright portion 14*b* is inclined about its lower end in a direction opposite to the sheet conveyance direction in association with the movement of the guide pin 5, as shown in FIG. 40. That is, the upper end of the upright portion 14*b* is pushed by the guide pin 5, and the upper end of the upright portion 14*b* is moved in a direction away from the right end of the guide hole 13, namely, in the direction opposite to the sheet conveyance direction, whereby the upright portion 14*b* is retracted from or gets out of the moving region of the guide pin 5. When the guide pin 5 comes out of the guide hole 13 by the pivotal movement of the upper casing 1*a*, the guide pin 5 and the guide hole 13 are disengaged from each other. On this occasion, the upright portion 14*b* returns, by its own restoring force, to a return position located slightly downward of the pressing position in the sheet conveyance direction, as shown in FIG. 4D.

When the upper casing 1*a* is pivoted from the separate position to the close position with the heads 10 located at the recording position, the distal end of the guide pin 5 comes into contact with the upper end of the upright portion 14*b*. Subsequently, the upright portion 14*b* is pushed by the guide pin 5 in association with the movement of the guide pin 5, so that the upright portion 14*b* is once inclined toward a position which is upstream of the pressing position in the sheet conveyance direction, namely, the upright portion 14*b* is retracted from or gets out of the moving region of the guide pin 5. Thereafter, when the upper casing 1*a* is positioned at the close position, the upright portion 14*b* is positioned at the pressing position so as to bias the guide pin 5 in the sheet conveyance direction.

In the vicinity of the opening of the guide hole 12, a conical tapered portion 12*a* is formed, whereby the guide pin 4 is easily inserted into the guide hole 12 when the upper casing 1*a* is pivoted from the separate position to the close position. Similarly, a conical tapered portion 13*a* is formed in the vicinity of the opening of the guide hole 13, whereby the guide pin 5 is easily inserted into the guide hole 13 when the upper casing 1*a* is pivoted from the separate position to the close position. The upper end of the upright portion 14*b* is bent, thereby enlarging an insertion space defined by the upright portion 14*b* and the guide hole 13 into which the guide pin 5 is to be inserted. This also facilitates insertion of the guide pin 5 into the guide hole 13 when the upper casing 1*a* is pivoted from the separate position to the close position.

Thus, the engagement of the guide pins 4, 5 and the guide holes 12, 13 permits positioning of the frame 3 and the frame 11 relative to each other in the main scanning direction and positioning with respect to the relative rotational position of the frame 3 and the frame 11 along the horizontal plane. Further, the guide pin 5 is biased by the movable member 14 in the sheet conveyance direction when the upper casing 1*a* is located at the close position and the heads 10 are located at the recording position, whereby the guide pin 5 and the guide hole 13 are positioned relative to each other in the sub scanning direction. In other words, the guide pin 5 is biased by the movable member 14, whereby the relative position of the frame 3 and the fame 11 in the sub scanning direction can be fixed The distance in the sub scanning direction between the shaft 1*h* and the pair of the guide pin 4 and the guide hole 12 and the distance in the sub scanning direction between the shaft 1*h* and the pair of the guide pin 5 and the guide hole 13 are mutually different. Accordingly, when the upper casing 1*a* is pivoted from the separate position to the close position, the guide pin 4 and the guide hole 12 with a smaller distance from the shaft 1*h* come into engagement with each other, before the guide pin 5 and the guide hole 13 with a larger distance from the shaft 1*h* come into engagement with each other. Accordingly; the guide pin 4 and the guide hole 12 are initially positioned relative to each other in the main scanning direction, thereby reducing a shift of the recording portion 9 and the support portion 60 relative to each other in the extension direction of the shaft 1*h*, namely, in the main scanning direction after the guide pin 4 and the guide hole 12 have been positioned relative to each other. Therefore, the guide pin 5 and the guide hole 13 with a larger distance from the shaft 1*h* easily come into engagement with each other when the upper casing 1*a* is pivoted further toward the close position. In addition, two pairs of the guide pin (4; 5) and the guide hole (12; 13) are provided, whereby the positioning with respect to the relative rotational position of the frame 3 and the frame 11 along the horizontal plane is conducted. Since the movable member 14 is provided in the guide hole 13 of one of the two pairs, the structure of the positioning mechanism is simplified. Moreover, since the movable member 14 is provided in the guide hole 13 which is away from the shaft 1*h* by a larger distance than a distance by which the guide hole 12 is away from the shaft 1*h*, it is possible to reduce the retracting amount of the movable member 14, thereby simplifying the structure of the movable member 14. This is because, in the moving region of the guide pin 5 that is located more distant from the shaft 1*h* than the guide pin 4, the sub-scanning directional component is smaller than that in the moving region of the guide pin 4. This is further because the shaft 1*h* is shifted upward or downward from a line connecting the two guide pins 4, 5, and an angle of a line connecting the shaft 1*h* and the guide pin 4 with respect to the extension direction of the guide pin 4 is different from an angle of a line connecting the shaft 1*h* and the guide pin 5 with respect to the extension direction of the guide pin 5.

Figure 6:
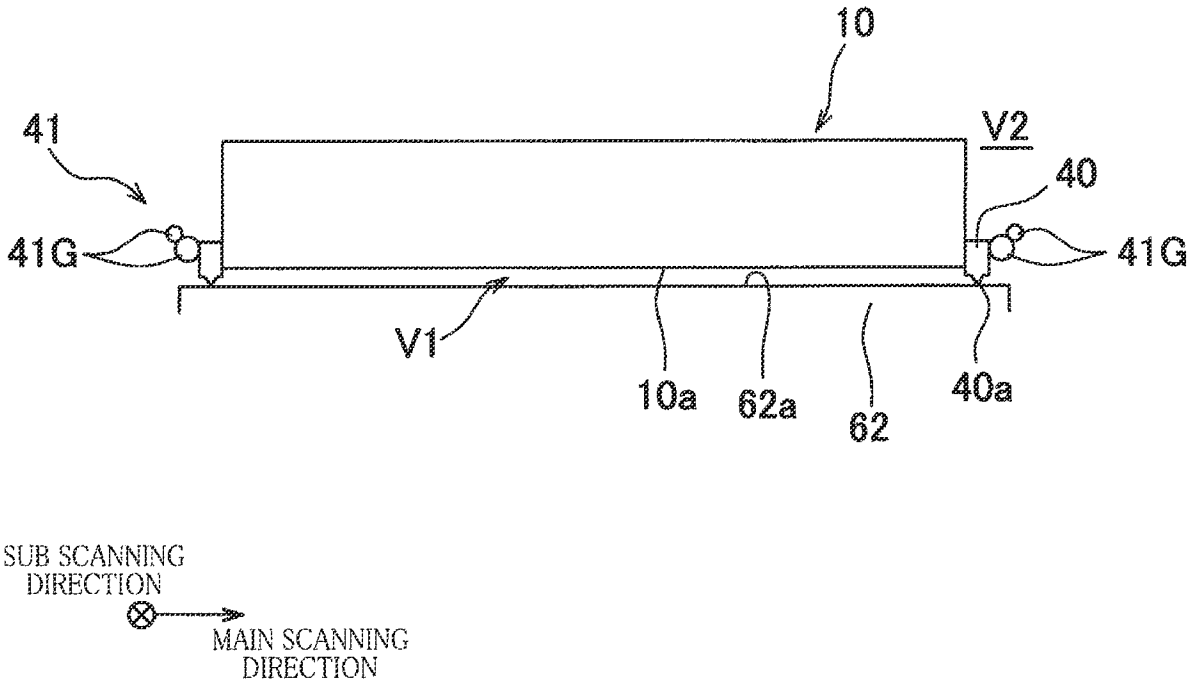
FIG. 6 is a schematic view showing a head and an enclosure member.

Next, the enclosure members 40 will be explained with reference to FIG. 6.

Each enclosure member 40 is formed of an elastic material such as rubber and has a short sleeve-like shape in plan view, so as to enclose or surround the periphery of the ejection surface 10*a* of the corresponding head 10. The enclosure member 40 has, at its lower end, a protruding portion 40*a* having an inverted triangular cross sectional shape.

The enclosure members 40 are configured to be elevated and lowered by a cap elevating and lowering mechanism 41 in the vertical direction. The cap elevating and lowering mechanism 41 includes a plurality of gears 41G and drive motors 41M (FIG. 7) for driving the gears 41G. By driving the gears 41G, the enclosure members 40 are elevated and lowered in the vertical direction (as the prescribed direction). By the movement of the enclosure members 40 upward and downward, the protruding portions 40*a* are selectively positioned at one of: an elevated position at which the protruding portions 40*a* are located at a higher position than the ejection surfaces 10*a*; and a lowered position at which the protruding portions 40*a* are located at a lower position than the ejection surfaces 10*a* and contact the corresponding opposable faces 62*a*. The distance over which the enclosure members 40 can move in the vertical direction is determined so as to enable the enclosure members 40 to contact the corresponding opposable faces 62*a* when the heads 10 are positioned at either of the first and the second recording positions. In other words, the recording position of the recording portion 9 also functions as a capping position at which the ejection surfaces 10*a* of the heads 10 are hermatically sealed as described below by moving the enclosure members 40 to the lowered position.

The controller 1*p* controls the cap elevating and lowering mechanism 41 (the drive motors 41M) to drive the gears 41G, such that the enclosure members 40 are positioned at the lowered position (FIG. 6) for capping the corresponding ejection surfaces 10*a* and such that the enclosure members 40 are positioned at the elevated position when the ejection surfaces 10*a* need not be capped. During capping, each ejection surface 10*a* is hermatically sealed by abutting contact of the tip of the protruding portion 40*a* with the opposable face 62*a*, as shown in FIG. 6, namely an ejection space V1 formed between the ejection surface 10*a* and the opposable face 62*a* is separated from an external space V2, thereby preventing the liquid in the vicinity of the ejection openings of the ejection surface 10*a* from drying. Thus, the enclosure members 40 and the cap elevating and lowering mechanism 41 constitute a capping mechanism.

Referring next to FIG. 7, the electric structure of the printer 1 will be explained.

The controller 1*p* includes a Central Processing Unit (CPU) 101 as an arithmetic processing unit, a Read Only Memory (ROM) 102, a Random Access Memory (RAM) 103 including a nonvolatile RAM, an Application Specific Integrated Circuit (ASIC) 104, an Interface (I/F) 105, an Input/Output Port (I/O) 106, etc. In the ROM 102, programs to be executed by the CPU 101 and various fixed data are stored. In the RAM 103, data necessary when the programs are executed is temporarily stored. In the ASIC 104, rewriting and sorting of image data such as signal processing and image processing are executed. The I/F 105 transmits and receives data to and from an external device such as a personal computer (PC) connected to the printer 1. The I/O 106 carries out an input/output of detection signals of various sensors.

The controller 1*p* is connected to a sheet supply motor 21M, feed motors 22M-28M, the sheet sensor 32, the head elevating and lowering mechanism 33, the wiper moving mechanisms 68, control circuit boards of the heads 10, etc. The controller 1*p* is connected further to the pumps 34, rotation motors 63M, and the drive motors 41M. While the pump 34, the rotation motor 63M, and the drive motor 41M are provided for each of the two heads 10, only one pump 34, one rotation motor 63M, and one drive motor 41M of one head 10 are shown in FIG. 7 in the interest of brevity.

The control executed by the controller 1*p* will be next explained with reference to FIG. 8.

Figure 8:
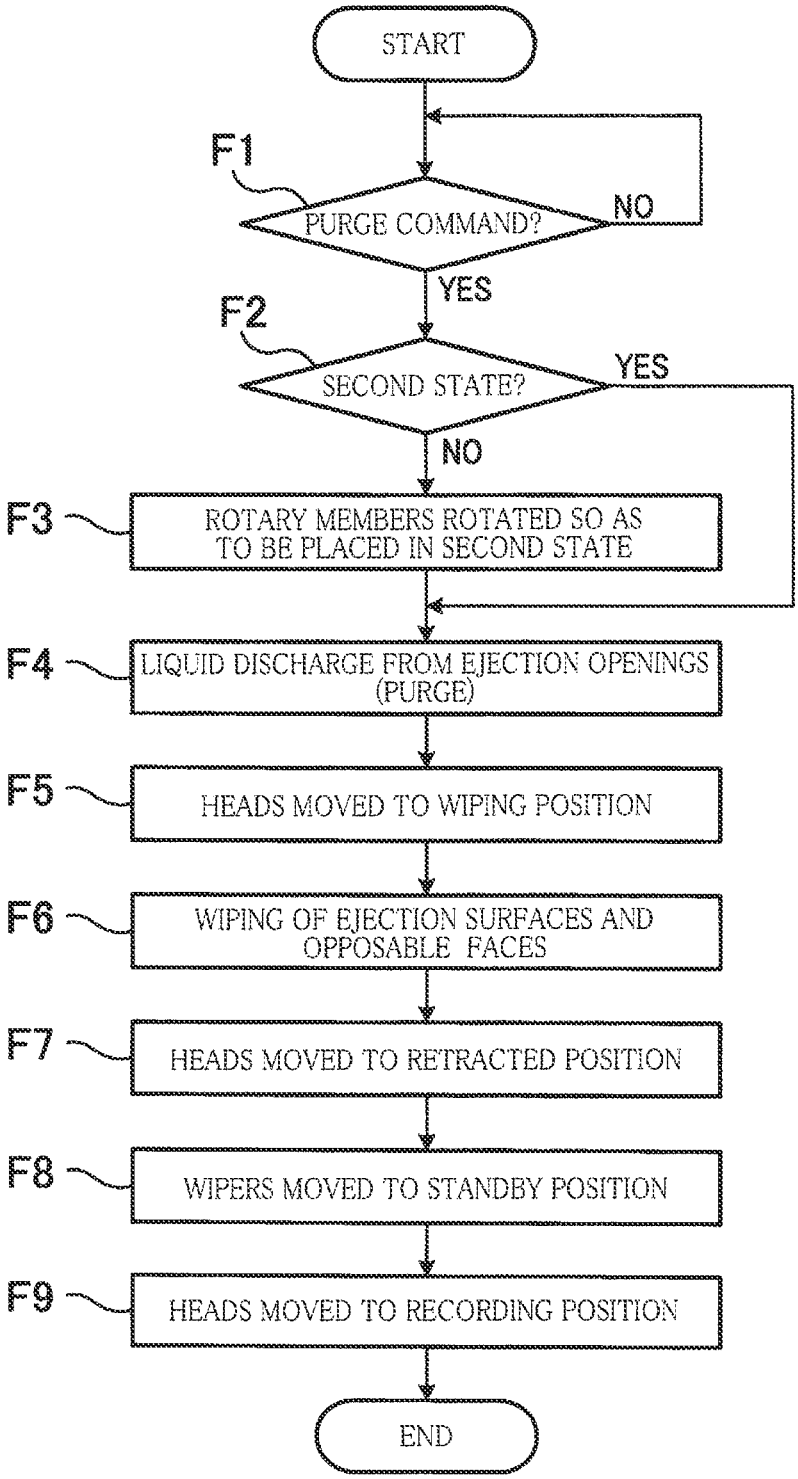
FIG. 8 is a flow chart showing a control executed by a controller of the printer.

As shown in FIG. 8, the controller 1*p* initially judges whether a purge command is received or not (Step 1: F1). The purge command is received when paper jamming occurs in the sheet conveyance path, or after non-ejection has continued for more than a predetermine time, for instance.

When the controller 1*p* receives the purge command (F1: YES), the controller 1*p* judges whether the rotary members 63 are in the second state or not (Step 2: F2). Where it is judged in Step 2 that the rotary members 63 are in the first state, Step 3 (F3) is implemented. Where it is judged in Step 2 that the rotary members 63 are in the second state, Step 4 (F4) is implemented. In Step 3, the controller 1*p* drives the rotation motors 63M so as to rotate the rotary members 63, whereby the rotary members 63 are placed in the second state.

Figure 9A:
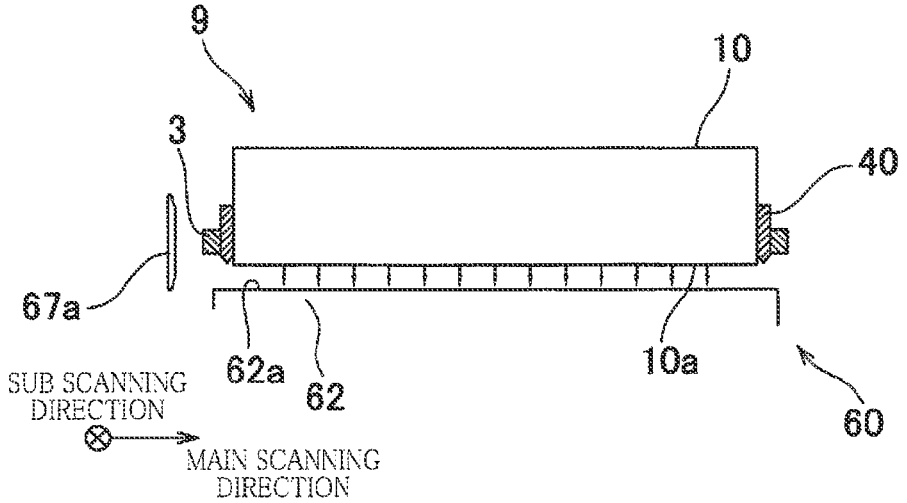
FIGS. 9A-9C are views for explaining a purging operation and a wiping operation.
Figure 9B:
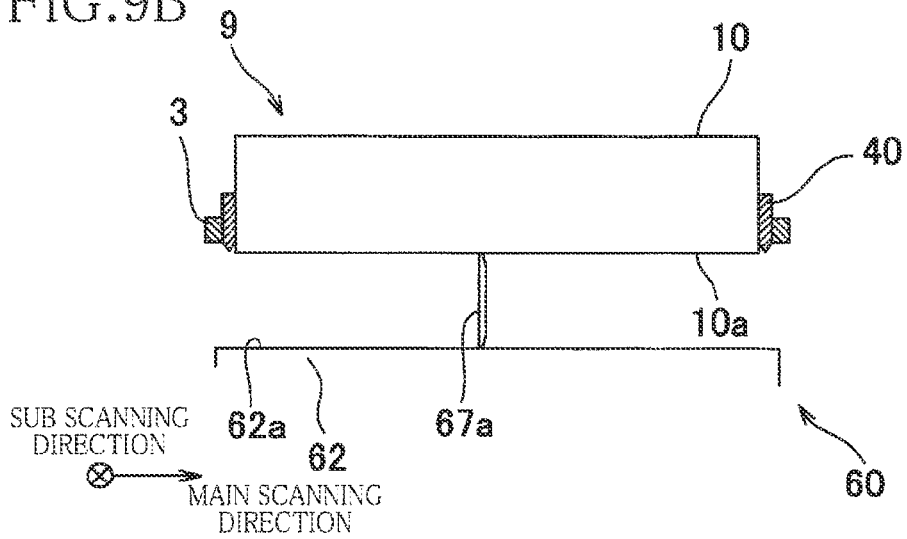

In Step 4, the controller 1*p* drives the pumps 34 such that the liquids are discharged by a predetermined amount onto the respective opposable faces 62*a* from all of the ejection openings as shown in FIG. 9A, namely; the purging operation is carried out. Subsequently, the controller 1*p* controls the head elevating and lowering mechanism 33 to move the heads 10 from the recording position to the wiping position as shown in FIG. 913 (Step 5: F5). At the wiping position which is between the retracted position and the second recording position, the guide pins 4, 5 are not in engagement with the respective guide holes 12, 13 and the upper ends of the respective wipers 67*a* contact the corresponding ejection surfaces 10*a* by the movement of the wipers 67*a* in the main scanning direction. Further, at the wiping position, the lower ends of the respective wipers 67*a* contact the corresponding opposable faces 62*a* by the movement of the wipers 67*a* in the main scanning direction. It is noted that, when the heads 10 are positioned at the retracted position, the wipers 67*a* do not come into contact with the corresponding ejection surfaces 10*a* even where the wipers 67*a* move in the main scanning direction so as to pass respective positions at which the wipers 67*a* are opposed to the corresponding ejection surfaces 10*a*.

After Step 5, the controller 1*p* controls the wiper moving mechanisms 68 to move the respective wipers 67*a* from the standby position in the main scanning direction, so that the ejection surfaces 10*a* and the opposable faces 62*a* are wiped, namely, the wiping operation is carried out (Step 6: F6). Thus, the liquid adhering to the ejection surface 10*a* and the opposable face 62*a* of each head 10 is removed therefrom.

Figure 9C:
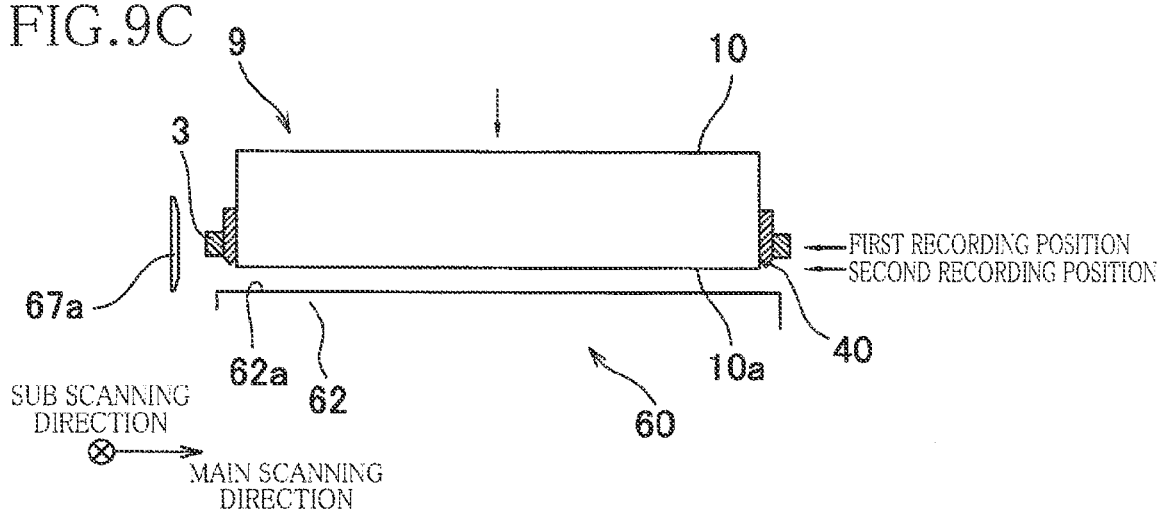

After Step 6, the controller 1*p* controls the head elevating and lowering mechanism 33 to move the heads 10 from the wiping position to the retracted position (Step 7: F7). Subsequently, the controller 1*p* controls the wiper moving mechanisms 68 to return the respective wipers 67*a* to the standby position (Step 8: F8). In this instance, the wipers 67*a* again wipe only the corresponding opposable faces 62*a*. After Step 8, the controller 1*p* controls the head elevating and lowering mechanism 33 to move the heads 10 from the retracted position to the recording position as shown in FIG. 9C (Step 9: F9). On this occasion, the heads 10 are normally moved to the first recording position. However, where the record command in which setting of the sheet P to be used is thick paper setting is received before the heads 10 are moved to the first recording position, the heads 10 are disposed at the second recording position. It is noted that the above-described purging operation and wiping operation may be carried out for only one of the two heads 10.

Thereafter, the controller 1*p* judges whether or not the record command is received, before a predetermined time elapses. Where the record command is not received before the predetermined time elapses, the capping operation is carried out. That is, the controller 1*p* drives the drive motors 41M to move the respective enclosure members 40 from the elevated position to the lowered position, thereby establishing a capping state in which the ejection space V1 is separated from the external space V2, namely, in which drying of the liquid in the vicinity of the ejection openings of each ejection surface 10*a* is restrained. The controller 1*p* then maintains the capping state until next record command or purge command is received.

As explained above, since the heads 10 are located at the capping position in the capping state, the guide pins 4, 5 are in engagement with the respective guide holes 12, 13. In this instance, even if the upper casing 1*a* is moved by the user from the close position to the separate position, the movable member 14 (the upright portion 14*b*) disposed in the guide hole 13 is retracted in association with the movement of the guide pin 5. Accordingly, it is possible to prevent interference between the inner wall of the guide hole 13*a* and the guide pin 5 while ensuring positioning of the recording portion 9 and the support portion 60 relative to each other in the main scanning direction and in the sub scanning direction.

On the other hand, where the record command is received before the predetermined time elapses, the controller 1*p* judges whether the rotary members 63 are in the first state or not. Where the rotary members 63 are in the second state, the controller 1*p* drives the rotation motors 83M so as to rotate the rotary members 63, whereby the rotary members 63 are placed in the first state. Where the rotary members 63 are in the first state, on the other hand, the first state is maintained. Thereafter, the controller 1*p* permits execution of the image recording operation on the basis of the received record command.

In the image recording operation, the controller 1*p* controls the head elevating and lowering mechanism 33 to dispose the heads 10 at one of the first and the second recording positions and drives the sheet supply motor 21M (FIG. 7) for the sheet supply roller 21 and the feed motors 22M-28M (FIG. 7) for the respective feed roller pairs 22-28, on the basis of the record command received from the external device. The sheet P supplied from the sheet tray 20 is fed to the support portion 60 through the guides 29. The sheet P fed to the support portion 60 is conveyed while being supported on the support surfaces 61*a* and held or nipped by the rollers of the respective feed roller pairs 23, 24, 25 that are being rotated. When the sheet P passes right below the two heads 10 successively, the heads 10 are driven under the control of the controller 1*p* and the liquid is ejected to the surface of the sheet P from the ejection openings of each ejection surface 10*a*, so that an image is formed on the sheet P. The liquid ejecting operation from the ejection openings of each ejection surface 10*a* is carried out under the control of the controller 1*p* on the basis of the detection signal of the sheet sensor 32. The sheet P is subsequently conveyed upward while being guided by the guides 29 and held or nipped by the rollers of the respective feed roller pairs 26, 27, 28, and finally discharged to the discharge portion 31 through an opening 30 formed in the upper portion of the upper casing 1*a*.

When the sheet P is being conveyed on the basis of the record command or when the sheet P is jammed in the midst of conveyance of the sheet P on the basis of the record command, the guide pins 4, 5 and the guide holes 12, 13 are in engagement with each other since the heads 10 are located at the recording position. In those instances, even where the upper casing 1*a* is moved by the user from the close position to the separate position, for instance, the movable member 14 (the upright portion 14*b*) disposed in the guide hole 13 is retracted in association with the movement of the guide pin 5. Therefore, it is possible to prevent interference between the inner wall of the guide hole 13 and the guide pin 5 while ensuring positioning of the recording portion 9 and the support portion 60 relative to each other in the main scanning direction and in the sub scanning direction.

As explained above, in the printer 1 according to the present embodiment, when the upper casing 1*a* is pivoted between the close position and the separate position, the movable member 14 is pushed by the guide pin 5 in association with the movement of the guide pin 5, so that the movable member 14 is retracted from the moving region of the guide pin 5. Accordingly, it is possible to ensure a high degree of positioning accuracy by the engagement of the guide hole 13 and the guide pin 5 while restraining interference of the guide pin 5 and the inner wall of the guide hole 13 (at one end of the inner wall of the guide hole 13 in the sub scanning direction, namely, at the upstream end of the guide hole 13 in the sheet conveyance direction), when the upper casing 1*a* is pivoted.

Since the positioning mechanism is constituted by the guide pins 4, 5 and the guide holes 12, 13, the recording portion 9 and the support portion 60 can be positioned relative to each other in the main scanning direction and in the sub scanning direction, and the positioning with respect to the relative rotational position of the recording portion 9 and the support portion 60 along the horizontal plane can be conducted. If the guide pin 5 and the inner wall of the guide hole 13 are configured not to interfere with each other when the upper casing 1*a* is pivoted from the close position to the separate position by forming the guide hole 13 similarly to the guide hole 12 without providing the movable member 14, the recording portion 9 and the support portion 60 cannot be positioned relative to each other in the sub scanning direction. If the relative position of the recording portion 9 and the support portion 60 in the sub scanning direction cannot be fixed, the recording portion 9 and the support portion 60 may be shifted relative to each other in the sub scanning direction, and the heads 10 and the opposable faces 62*a* may be shifted relative to each other. In those instances, there may be a risk that the position of the sheet P at which the image is formed may be shifted from an intended position and a risk that the ejection surfaces 10*a* cannot be capped by the enclosure members 40. For enabling the ejection surfaces 10*a* to be capped even where the recording portion 9 and the support portion 60 are shifted relative to each other in the sub scanning direction, it is needed to enlarge the size of the opposable faces 62*a*, undesirably resulting in an increase in the size of the printer 1 per se. In the present invention, however, the movable member 14 biases the guide pin 5 in the sub scanning direction (the sheet conveyance direction), whereby the positioning in sub scanning direction is conducted. Thus, the problems described above are not encountered.

Since the present printer 1 is equipped with the head elevating and lowering mechanism 33, the recording portion 9 and the support portion 60 can be relatively moved toward and away from each other between the recording position and the retracted position (the wiping position) without a need of pivoting the upper casing 1*a*. Further, the recording portion 9 can be moved to the first recording position and the second recording position by the head elevating and lowering mechanism 33, the position of the heads 10 can be changed depending upon the thickness of the sheet P. Moreover, the present printer 1 is equipped with the capping mechanism constructed as described above, the ejection surfaces 10*a* can be capped at the recording position. The capping mechanism constructed as described above eliminates a need of largely moving the recording portion 9 or the support portion 60 for capping, thereby eliminating provision of a space in which the recording portion 9 or the support portion 60 is retracted. Accordingly, the printer 1 can be downsized. In addition, the user can freely pivots the upper casing 1*a* to the separate position even when the ejection surfaces 10*a* are in the capping state.

While the embodiment of the invention has been described, it is to be understood that the present invention may be embodied with various other changes and modifications, which may occur to those skilled, in the art, without departing from the scope of the invention defined in the attached claims.

For instance, only one pair of the guide pin and the guide hole may be provided as the positioning mechanism. The movable member 14 may be disposed in the guide hole 12. In this instance, the guide hole 13 may be formed similarly to the guide hole 12. The movable member 14 may be disposed in both of the guide hole 12 and the guide hole 13.

Figure 10:
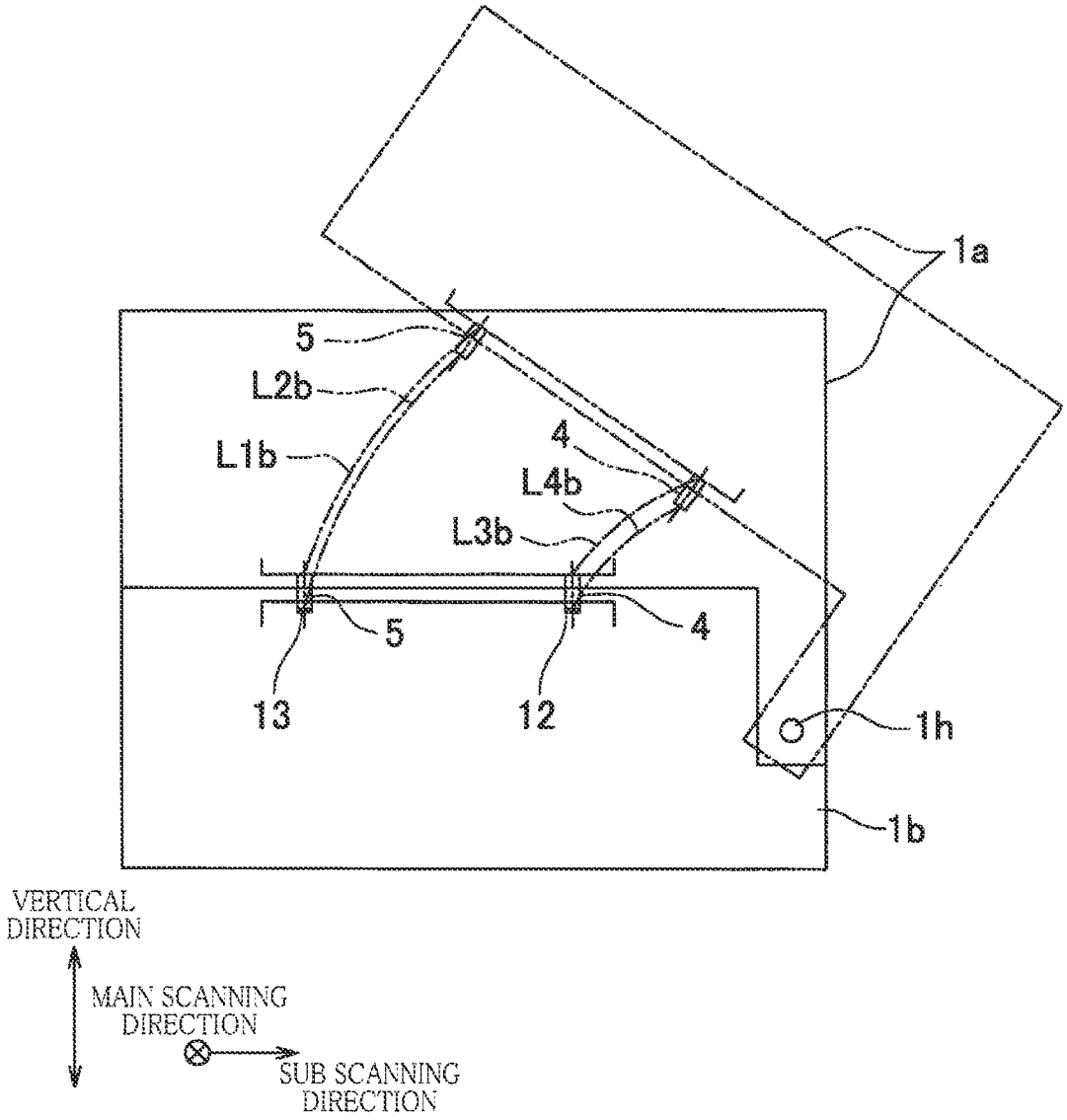
FIG. 10 is a view showing a modification in which a pivotal center exists in a lower casing, the view being for explaining a pivotal locus of each guide pin when the upper casing is pivoted.

As shown in FIG. 10, where the upper casing 1*a* is pivotably supported by the shaft 1*h* at a substantially vertically middle position of the right end (FIG. 10) of the lower casing 1*b*, for example, the movable member 14 may be fixed to the other end of the guide hole 13 in the sub scanning direction, i.e., the downstream end in the sheet conveyance direction. In this instance, when the upper casing 1*a* is pivoted from the close position to the separate position, the guide pin 4, 5 engaging the respective guide holes 12, 13 come out of the guide holes 12, 13 while moving, with respect to the guide holes 12, 13, toward the upper right side in FIG. 10, namely, toward the downstream side in the sheet conveyance direction. Accordingly, the movable member 14 may be disposed in the guide hole 13 so as to bias the guide pin 5 in a direction opposite to the biasing direction of the illustrated embodiment. That is, the guide hole 13 may be formed to have a shape obtained by revolution by an angle of 180° about its vertical axis. In this instance, the guide hole 12 may be formed so as to have a shape also obtained by revolution. In this arrangement, when the upper casing 1*a* is pivoted from the close position to the separate position with the heads 10 located at the recording position, the guide pins 4, 5 move toward the right ends of the inner wall surfaces of the respective guide holes 12, 13 (i.e., the downstream ends of the guide holes 12, 13 in the sheet conveyance direction) while separating from the left ends of the inner wall surface of the respective guide holes 12, 13 (i.e., the upstream ends of the guide holes 12, 13 in the sheet conveyance direction). Even if the guide pins 4, 5 move as described above, the guide pin 4 and the inner wall of the guide hole 12 do not interfere with each other, and the movable member 14 is retracted from or gets out of the moving region of the guide pin 5, so that the guide pin 5 and the inner wall of the guide hole 13 do not interfere with each other. Therefore, it is possible to ensure advantages similar to those described above. In this arrangement, too, as shown in FIG. 10, the sub-scanning directional component of the moving region (the region between two arcs L1*b*, L2*b* indicated by the long dashed double-short dashed lines) of the guide pin 5 which is located more distant from the shaft 1*h* than the guide pin 4 is smaller than the sub-scanning directional component of the moving region (the region between two arcs L3*b*, L4*b* indicated by the long dashed double-short dashed lines) of the guide pin 4. Accordingly, the structure of the movable member 14 can be simplified because of provision of the movable member 14 in the guide hole 13.

The movable member 14 may be formed an elastic member other than the leaf spring. The two pairs of the guide pin (4; 5) and the guide hole (12; 13) may be disposed so as to be arranged in a direction that intersects the sub scanning direction and the main scanning direction. The guide holes 12, 13 may be provided in the recording portion 9 while the guide pins 4, 5 may be provided in the support portion 60. Where the upper casing 1*a* is fixed to the recording portion 9, the guide pin or the guide hole may be provided in the upper casing 1*a*. Where the support portion 60 is fixed to the lower casing 1*b*, the guide pin or the guide hole may be provided in the lower casing 1*b*. In short, the guide pin or the guide hole may be formed at a position where the recording portion 9 and the support portion 60 can be positioned relative to each other by engagement of the guide pin and the guide hole. The guide holes 12, 13 may be formed so as to penetrate the frame 11. The recording portion may be constituted only by the heads 10. In this instance, the guide pin or the guide hole may be formed directly in the heads 10.

Two pairs of the guide pin and the guide hole may be disposed at respective positions at which respective distances from the shaft 1*h* are mutually the same, such that the two pairs are arranged in the main scanning direction. In this arrangement, where the movable member is provided in the guide hole of only one of the two pairs, it is possible to ensure advantages similar to those described above. Three or more pairs of the guide pin and the guide hole may be provided. The guide pin may have a length that enables engagement thereof with the guide hole when the upper casing 1*a* is located at the close position even where the heads are located at either of the retracted position and the wiping position. In the illustrated embodiment, the moving mechanism in the form of the head elevating and lowering mechanism 33 is used. The moving mechanism may not be provided. The moving mechanism may be configured to elevate and lower the support portion 60 or may be configured to elevate and lower both of the recording portion 9 and the support portion 60. The recording position may include only the first recording position. The capping mechanism may be eliminated. The capping position may be different from the recording position. The wiping position may be referred to as a third position.

The present invention is applicable to both of a serial type and a line type, and is applicable to a facsimile machine and a copying machine other than the printer. The present invention is applicable to recording apparatus configured to carry out recording by ejecting a liquid other than the ink. The present invention is applicable to recording apparatus other than the ink-jet type, such as a laser type and a thermal type. The recording medium is not limited to the sheet P, but may be various recordable media.

What is claimed is:

1. A recording apparatus, comprising:

a support portion configured to support a recording medium;

a recording portion configured to record an image on the recording medium supported by the support portion;

a first casing configured to hold the support portion;

a second casing connected to the first casing through a shaft and pivotable relative to the first casing about the shaft, the second casing being configured to be selectively positioned by a pivotal movement thereof at one of: a close position at which the second casing is positioned close to the first casing; and a separate position at which the second casing is positioned more distant from the first casing than when the second casing is positioned at the close position, the second casing being configured to hold the recording portion such that the support portion and the recording portion are opposed to each other when the second casing is positioned at the close position;

a positioning mechanism comprising a guide pin that extends in a prescribed direction and a guide hole which move relative to each other in association with the pivotal movement of the second casing, the positioning mechanism being configured to define a relative position of the recording portion and the support portion by engagement of the guide pin and the guide hole when the second casing is positioned at the close position; and a movable member disposed at one end of the guide hole in an orthogonal direction orthogonal to both of the prescribed direction and an extension direction in which the shaft extends, the movable member being configured to move in a direction away from the other end of the guide hole in the orthogonal direction, whereby the movable member is retracted from a moving region of the guide pin that moves relative to the guide hole in association with the pivotal movement of the second casing, the movable member being made of elastic material, wherein the movable member is configured to bias the guide pin that is in engagement with the guide hole in a direction toward the other end of the guide hole such that the guide pin contacts the other end of the guide hole, wherein the movable member comprises:

a first member, one end of which is fixed to the one end of the guide hole, extending toward the other end of the guide hole in the orthogonal direction; and a second member extending from the other end of the first member and comprising:

a first inclining portion, one end of which is connected to the other end of the first member, inclining such that the one end of the first inclining portion is farther from the other end of the guide hole than the other end of the first inclining portion, and a second inclining portion, one end of which is connecting to the other end of the first inclining portion, inclining such that the one end of the second inclining portion is farther from the one end of the guide hole than the other end of the second inclining portion.

2. The recording apparatus according to claim 1, wherein the positioning mechanism comprises a plurality of pairs of the guide pin and the guide hole the plurality of pairs being disposed so as to have mutually different distances from the shaft.

3. The recording apparatus according to claim 2, wherein the positioning mechanism comprises two pairs of the guide pin and the guide hole, and wherein the movable member is disposed in the guide hole of only one of the two pairs.

4. The recording apparatus according to claim 3, wherein the movable member is disposed in the guide hole belonging to one of the two pairs disposed so as to have a larger distance from the shaft.

5. The recording apparatus according to claim 1, wherein the guide pin is provided in the recording portion and the guide hole is provided in the support portion.

6. The recording apparatus according to claim 5, further comprising a moving mechanism configured to move at least one of the recording portion and the support portion in the prescribed direction, such that the recording portion and the support portion are selectively positioned at one of a first position and a second position, a distance between the recording portion and the support portion at the second position being larger than a distance therebetween at the first position, when the second casing is positioned at the close position.

7. The recording apparatus according to claim 6, wherein the guide pin and the guide hole engage each other when the recording portion and the support portion are positioned at the first position, and the guide pin and the guide hole do not engage each other when the recording portion and the support portion are positioned at the second position.

8. The recording apparatus according to claim 7, wherein the first position is a recording position at which an image is recorded on the recording medium by the recording portion.

9. The recording apparatus according to claim 7, further comprising: an opposable portion configured to be opposed to the recording portion; and a capping mechanism comprising an enclosure member disposed around the recording portion so as to enclose a recording surface of the recording portion that is to be opposed to the opposable portion, the capping mechanism being configured to seal the recording surface by abutting contact of the enclosure member with the opposable portion, wherein the first position is a capping position at which the recording surface is sealed.

10. The recording apparatus according to claim 6, wherein the moving mechanism is configured to move the at least one of the recording portion and the support portion such that the recording portion and the support portion are positioned further at a third position between the first position and the second position.

11. The recording apparatus according to claim 1, wherein the movable member has an L-shaped cross sectional shape as viewed from the extension direction in which the shaft extends.

12. The recording apparatus according to claim 11, wherein the movable member has a first portion extending along the orthogonal direction and a second portion extending along the prescribed direction.

13. The recording apparatus according to claim 1, wherein the guide pin is a cylindrical member, and wherein the guide hole has, at one end thereof, an inner wall surface extending along the extending direction in which the shaft extends and has, at another end thereof, a semi-circular inner wall surface.

14. The recording apparatus according to claim 3, wherein the guide hole belonging to the other of the two pairs is long in the orthogonal direction.

* * * * *